US005169372A

United States Patent [19]

Tecco

[11] Patent Number: 5,169,372

[45] Date of Patent: Dec. 8, 1992

[54] EXERCISE DEVICE

[76] Inventor: Armand Tecco, 545 Atterbury Rd., Villanova, Pa. 19085

[21] Appl. No.: 670,448

[22] Filed: Mar. 8, 1991

Related U.S. Application Data

[63] Continuation-in-part of Ser. No. 499,171, Mar. 23, 1990, abandoned.

[51] Int. Cl.[5] ..... A63B 26/00

[52] U.S. Cl. ..... 482/140; 482/105

[58] Field of Search ..... 272/94, 123, 143, 93; 2/417, 425; 128/25 R; 482/140, 93, 95, 96, 105

[56] References Cited

U.S. PATENT DOCUMENTS

| | | | |
|---|---|---|---|
| 3,820,780 | 6/1974 | Tarbox | 272/94 |
| 3,820,781 | 6/1974 | Kane | 272/93 |
| 4,168,060 | 9/1979 | Hohenfeldt | 272/94 |
| 4,274,628 | 6/1981 | Hoagland | 272/123 |
| 4,339,124 | 7/1982 | Vogler | 272/94 |
| 4,477,929 | 10/1984 | Mattsson | 2/417 |
| 4,664,373 | 5/1987 | Hait | 272/123 |
| 4,752,067 | 6/1988 | Colonello | 272/93 |
| 4,863,158 | 9/1989 | Tassone | 272/123 |
| 4,865,314 | 9/1989 | Carter | 272/123 |
| 4,867,444 | 9/1989 | Castillo | 272/123 |

OTHER PUBLICATIONS

Fitness Management—Jun. 1989—P. 47, Gym Equipment Co.—USA-U-Bar.

*Primary Examiner*—Stephen R. Crow

[57] ABSTRACT

An exercise device has a head-receiving portion adapted to be disposed against the head of a user. Integral with the head-receiving portion is a base that is adapted to be positioned against the neck of the user to brace the head and neck of the user and partially support the weight of the head while the user performs abdominal exercises. Grooves are provided along the back of the head-receiving portion to permit the user to manually grip the head-receiving portion. Weights are secured to the head-receiving portion. These weights may be detachably and removably secured.

5 Claims, 4 Drawing Sheets

FIG. 1
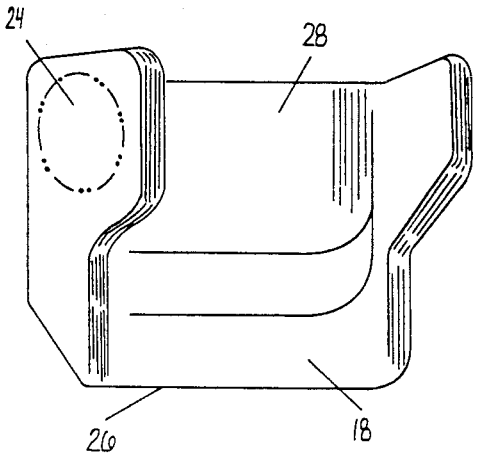
FIG. 2A
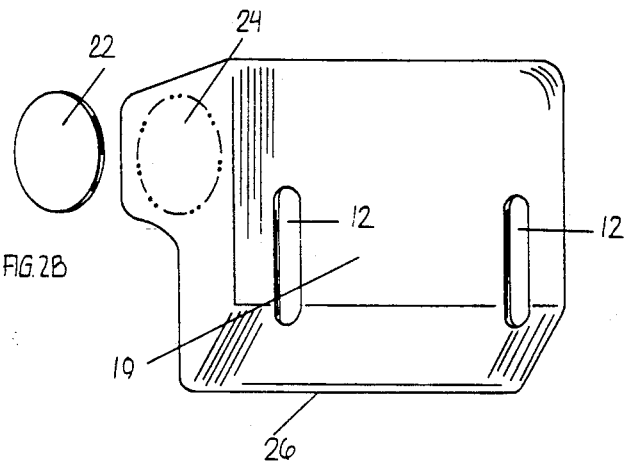
FIG. 2B
FIG. 3A
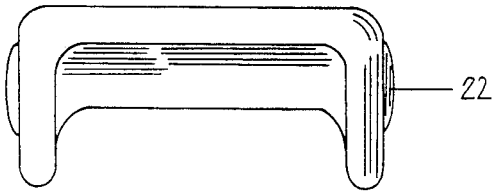
FIG. 3B
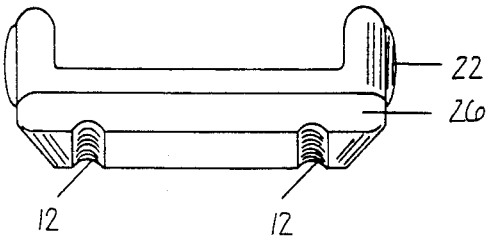
FIG. 4A
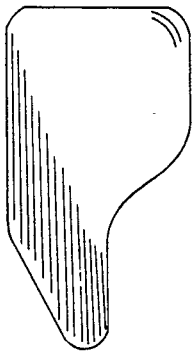
FIG. 4B
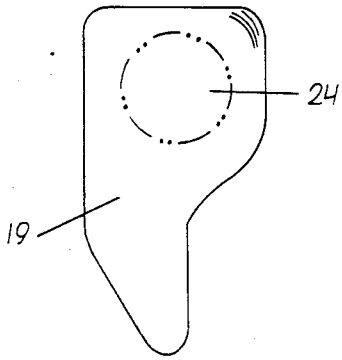

FIG. 5A
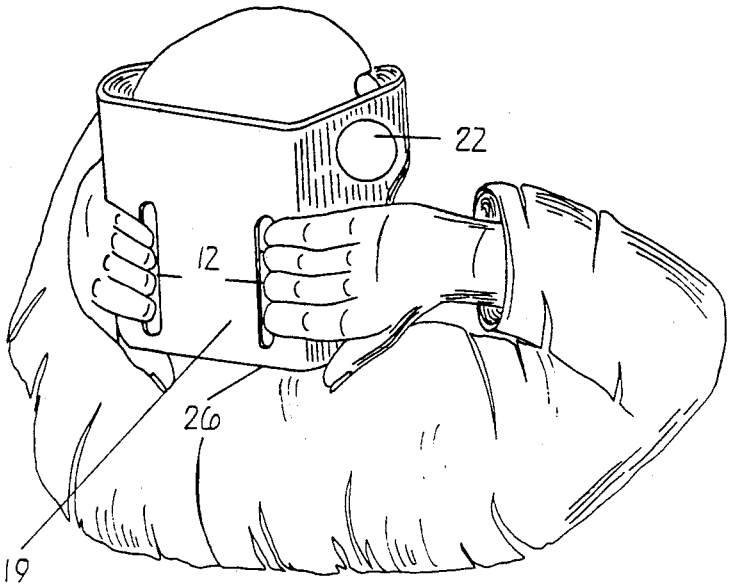
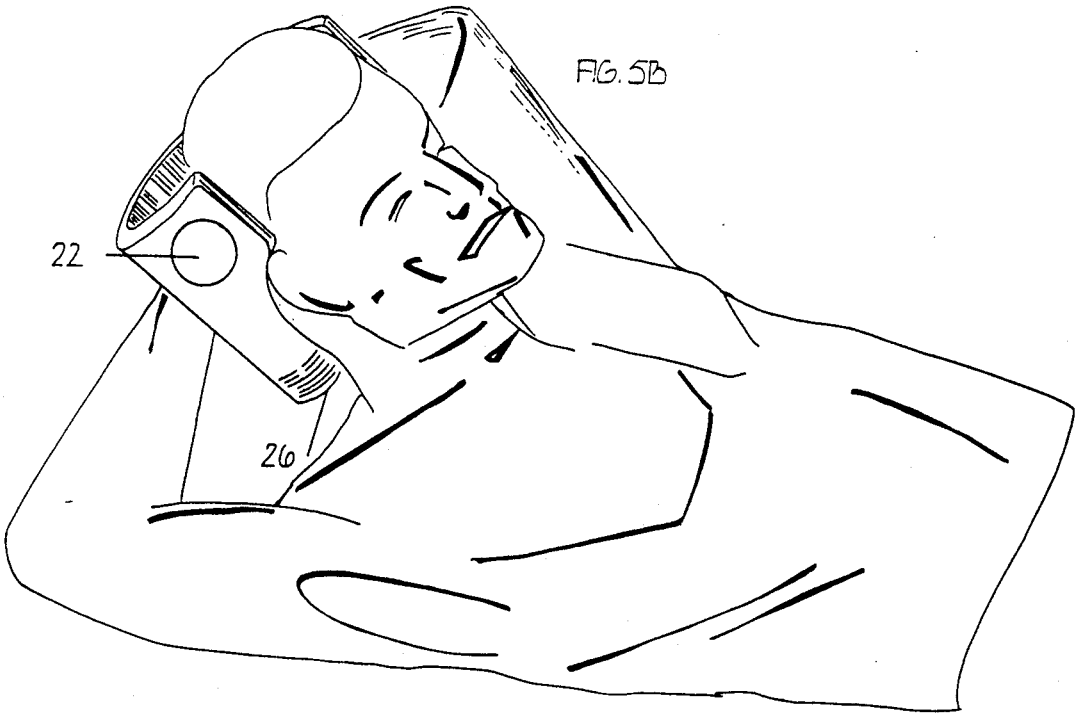
FIG. 5B

EXERCISE DEVICE

This is a continuation-in-part of copending application Ser. No. 07/499,171 filed on Mar. 23, 1990, abandoned.

BACKGROUND OF THE INVENTION

1. Field of the Invention

This invention relates to weights and a support system for exercising the abdominal muscles.

2. Prior art

Strengthening and toning the abdominal muscles is a common goal among exercise enthusiasts. Most of the methods used to meet this goal, however, have either biomechanical or physiological limitations.

Such methods that have physiological limitations are common trunk curl exercises that allow for a high number of repetitions, which have diminishing effects on the desired adaptations, i.e., stronger, firmer muscles.

In order for a muscle to become stronger and firmer, it has to work at certain intensity levels, below which negligible adaptations will occur. The muscles can only contract and perform for short periods of time when working at these higher intensity levels. To effectively train a muscle group for strengthening benefits, it is better to work at higher intensity levels and shorter durations.

Another physiological limitation of these exercises concerns neck muscle fatigue. As the various trunk curl exercises are performed, the trunk and head are lifted up and off the floor or bench. The weight of the head is supported by the neck muscles while the exercises are being performed. If the exerciser holds his/her hands behind his/her head, some weight may be relieved from the neck.

With many abdominal exercises, the exerciser's neck muscles become fatigued due to the prolonged and repeated isometric contractions that occur from having to support the head. This can result in stiff and/or sore neck muscles.

The basic abdominal curl exercise and its variations have a significant biomechanical limitation: the propensity for stretching the neck extensor muscles beyond their normal range of motion. This excessive flexing, which occurs when the exerciser allows his/her head to flex forward when performing the trunk curl exercise, can overstretch and strain the neck extensor muscles. This problem can be accentuated when the exerciser places the hands behind the top of the head and pulls, thus causing excessive neck flexion.

Another critical limitation of abdominal exercises concerns the effective and comfortable application of external resistance. By increasing the resistance that the abdominal muscles have to overcome to lift the trunk up and off the floor/bench when performing abdominal curl exercises, the intensity of the abdominal muscle effort is also increased. This increased effort is beneficial in that it results in a greater strengthening and toning effect on the abdominal muscles.

The relative degree of muscle strengthening that occurs during an athlete's training depends on the resistance which these muscles work against. Accordingly, any increase in resistance by means of weighted training devices, to impose more demands on these muscles and thereby strengthen them, is known to have a beneficial effect.

Up until now, the methods most commonly used to add resistance to abdominal curl exercises have involved barbell plates or dumbbells placed on the exerciser's chest or behind the head. These methods are not only awkward, cumbersome, and uncomfortable, but can be unsafe.

SUMMARY OF THE INVENTION

An exercise device has a head-receiving portion adapted to be placed against the head of a user. Integral with the head-receiving portion is a base which is adapted to be positioned against the neck of the user to brace the user's head and partially support the weight of the head while the user performs abdominal exercises.

BRIEF DESCRIPTION OF THE DRAWINGS

FIG. 1 is a frontal perspective view of the exercise device of the present invention including a base portion where the head and neck of a user rest as well as where weighted attachments are affixed, FIG. 2A is a rear perspective view illustrating where hand grooves are provided as well as how an attachment patch or pocket is built into each side, FIG. 2B shows a weighted attachment adapted to be detachably and removably secured to a patch or in a pocket, FIG. 3A is a top view of the exercise device of FIG. 1, FIG. 3B is a bottom view of the exercise device of FIG. 1, FIG. 4A is a cutaway side view of the exercise device of FIG. 1, showing a slope on the front base portion of the device, FIG. 4B is a side view of the exercise device of FIG. 1, FIGS. 5A, B is a representation of an exerciser using the exercise device of FIG. 1.

DETAILED DESCRIPTION OF THE INVENTION

Figure 6A:
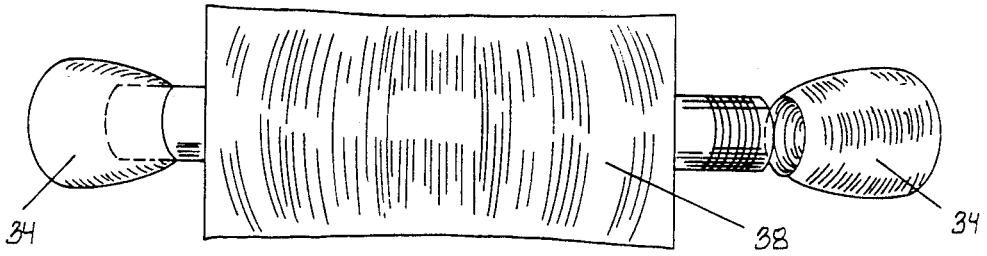
FIGS. 6A–D show an alternate embodiment of the exercise device of FIG. 1.

Referring now to the drawings, there is shown exercise device 10 of the present invention. Exercise device 10 is provided with hand grooves 12 for proper placement of the hands of the user during the exercise movement. Weights, including detachable weights 22 or removable weights 22, are evenly distributed and may be provided in various resistance amounts, such as one, two, three and four pounds to accommodate different fitness levels.

Head receiving upper region 28 of exercise device 10 is adapted to receive and support the head of a user during use of exercise device 10. Base region 19 of exercise device 10 is adapted to brace the neck of the user thereby partially supporting the weight of the head. Thus front portion 18 of base region 19 is anatomically structured to support the head and neck of a user during use of improved weight device 10. For example, bottom portion 26 of base region 19 rests against the neck of the user so that base front 18 can support the head and neck of the user while the user is performing trunk curl exercises. The foam of exercise device 10 is sculpted to protrude where the neck of the user rests against exercise device 10 and slope downward where the head of the user rests against weight device 28. The sides of base region 19 are shaped to stabilize the head without covering the ears.

Bottom portion 26 of base region 19 in the vicinity of front portion 18 where the neck of the user is disposed during the use of improved weight device 10 is angled to allow for a full range of motion during use. Weight attachments 22 are designed to be detachably and removably secured to the exterior portion of each side of exterior portion 24. Either attachment patches (not shown) on weighted attachments 22 and on the exterior portion 24 of exercise device 10 or pockets on the exterior portion 24 of weight device 10 allow weight attachments 22 to be detachable and removable. These pockets on exterior portion 24 serve as pouches into which weights may be inserted and securely held until removal from the pouches wherein it is understood that removal of the weights from the pouch is substanitally equivalent to detaching the weights from weight device 10.

Hand grooves 12 are located on the back of base region 19 of exercise device 10 and are positioned towards the bottom. Hand grooves 12 may have dimensions of approximately three inches in length, one inch in width and one inch in depth. In the preferred embodiment, hand grooves 12 may be placed approximately five inches apart or may be moved slightly in one direction or the other to provide optimal comfort and accommodate most hand sizes. The hand positioning is the preferred embodiment when performing trunk curl exercises with exercise device 10 because it helps support the head and neck and minimize excessive neck flexion. In addition, as it pertains to this invention, hand grooves 12 allow the hands to be unobstructed by the affixed weight attachment 22. It will be understood by those skilled in the art that any means of bracing exercise device 10 against the user and securing exercise device 10 in a position to support the head and neck of the user may be employed.

Weight attachments 22 preferably consist of flat weights cut from stock bar material. If attachment patches are used, the weights may be encapsulated by slightly padded vinyl-like casing which are adapted to be detachably secured. This would not be necessary if pockets are used.

Figure 6B:
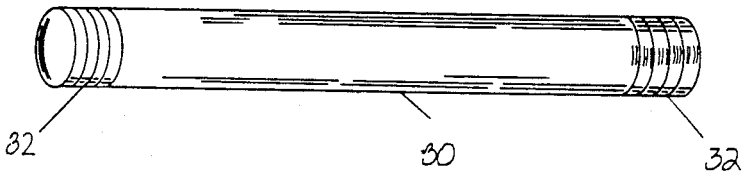
Figure 6C:
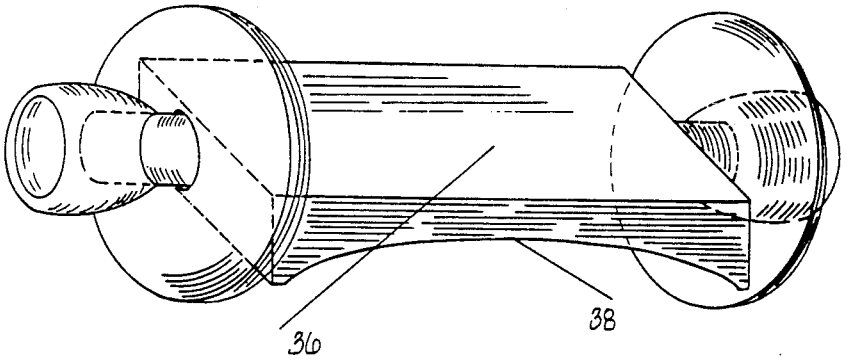
Figure 6C:
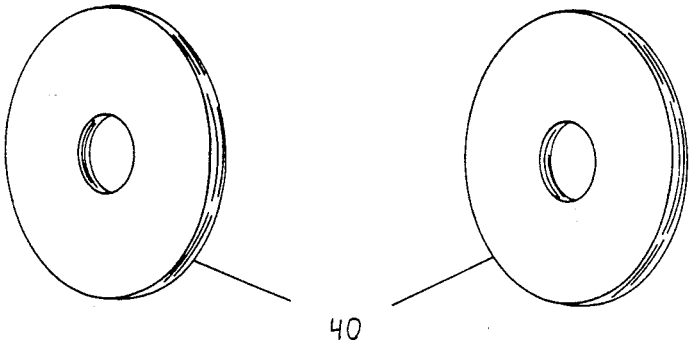
Figure 6D:
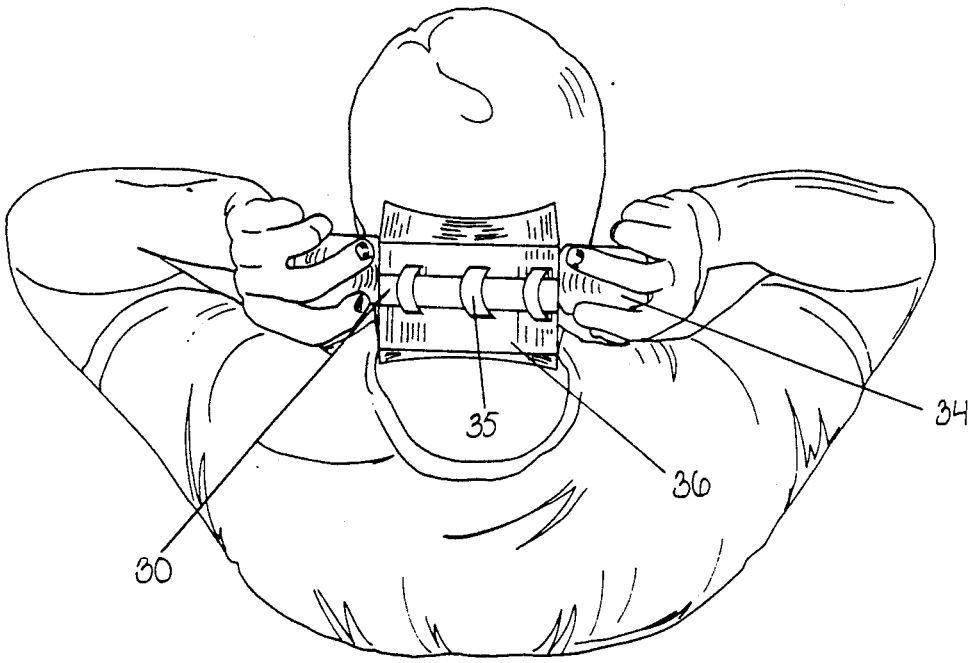

Referring now to FIGS. 6A–D, there is shown an alternative embodiment excercise device is formed of rod 30 having threaded portions 32 at opposing ends. Hand grips 34 are also provided with threads (not shown) for threadably mating with rod 30. Rod 30 may be rotatably attached to base 36 by a conventional attachment means such as straps 35 for positioning base 36 behind the middle of the neck wherein the middle of the neck is understood to be refer to the middle in the longitudinal direction.

Base 36 may be formed with a curvature 38 for better receiving the neck of a user of exercise device when exercise device is positioned behind the neck of the user approximately midway between the top of the neck and the bottom of the neck. Rod 30 extends outwardly beyond the ends of base 36 for a distance sufficient to permit weights 40 to be mounted on both ends of rod 30 and secured by hand grip 34 by threadably attached hand grips 34. The number of weights 40 and the mass of weights 40 which may be detachably secured to exercise device are variable.

The length and shape of hand grips 34 are designed to permit a neutral gripping position by the hands of a user of exercise device. Thus, the user of exercise device may avoid supinated positioning of the hands while gripping exercise device and performing exercises. As the user of exercise device grips exercise device in a neutral non-supinated gripping position and performs sit-ups, the positioning of base 36 rotatably changes with respect to rod 30 due to the changes in the relative positions of the parts of the body of the user during the performance of the sit-ups in order to reposition base 36 of device to support at least portions of the neck. Thus exercise device substantially prevents flexion of the neck of the user during sit-ups.

Thus, exercise device 10 increases the intensity of the abdominal muscle involvement during abdominal curl exercises by adding weighted resistance comfortably. Additionally, exercise device 10 reduces the amount of neck flexion and thereby reduces neck strain and fatigue resulting from the exercises by comfortably supporting the head during the exercises.

I claim:

1. An abdominal exercise device anatomically structured to support the head and neck of a user comprising: a semi-cylindrical head receiving upper portion which engages only the posterior portion of the user's head; a lower neck portion adapted to brace the neck of the user; means for disposing said head receiving portion against the head of the user comprising gripping means for manually gripping said head receiving portion; whereby said device partially supports the weight of the user's head during exercise.

2. The device of claim 1 wherein the weight is affixably secured to said head receiving portion.

3. The device of claim 1, further comprising a weight secured to said head-receiving portion.

4. The device of claim 3, wherein said weight is detachably secured to said head-receiving portion.

5. The device of claim 3, wherein the mass of said weight is variable.

* * * * *